US006380668B1

(12) United States Patent
Kim et al.

(10) Patent No.: US 6,380,668 B1
(45) Date of Patent: Apr. 30, 2002

(54) CATHODE RAY TUBE

(75) Inventors: Wan Kim; Do-Houn Pyun, both of Yongin-si; Soon-Chul Shin, Suwon-si, all of (KR)

(73) Assignee: Samsung Display Devices, Co., Ltd., Suwon-si (KR)

( * ) Notice: Subject to any disclaimer, the term of this patent is extended or adjusted under 35 U.S.C. 154(b) by 0 days.

(21) Appl. No.: 09/435,276

(22) Filed: Nov. 5, 1999

(30) Foreign Application Priority Data

Nov. 10, 1998 (KR) ..... 98-48059

(51) Int. Cl.[7] ..... H01J 29/86

(52) U.S. Cl. ..... 313/477 R; 220/2.1 A; 220/2.3 A

(58) Field of Search ..... 313/477 R, 440; 220/2.1 A, 2.3 A

(56) References Cited

U.S. PATENT DOCUMENTS 3,912,104 A * 10/1975 Schwartz ..... 220/2.1 A
5,258,688 A * 11/1993 Fondrk ..... 313/477 R
6,208,068 B1 * 3/2001 Lee et al. ..... 313/477 R

* cited by examiner

*Primary Examiner*—Ashok Patel
(74) *Attorney, Agent, or Firm*—Christie, Parker & Hale, LLP

(57) ABSTRACT

A cathode ray tube includes a panel having an inner phosphor screen, and a funnel having a panel sealing side, a cone portion and a neck sealing side. The panel sealing side of the funnel is sealed to the panel at a phosphor screen-side. A deflection yoke is mounted around the cone portion of the funnel. A neck is sealed to the neck sealing side of the funnel and an electron gun is mounted within the neck. The cone portion of the funnel is formed with a sectional shape where a circle gradually changes into a non-circle from a neck-side of the cone portion to a panel-side of the cone portion. The cone portion of the funnel has a thickness in a horizontal axis direction and a thickness in a diagonal axis direction, and the ratio of the diagonal thickness to the horizontal thickness ranges from 1.03 to 1.21.

6 Claims, 6 Drawing Sheets

CATHODE RAY TUBE

FIELD OF THE INVENTION

The present invention relates to a cathode ray tube (CRT), and more particularly, to a CRT that can increase an electron beam deflection efficiency while maintaining an appropriate atmospheric pressure resistance.

BACKGROUND OF THE INVENTION

Generally, CRTs include a panel having an inner phosphor screen, a funnel having a cone portion, and a neck having an electron gun therein, that are sequentially connected to each other. A deflection yoke is mounted around the cone portion of the funnel to form horizontal and vertical magnetic fields there. In this structure, electron beams emitted from the electron gun are deflected through the horizontal and vertical magnetic fields from the deflection yoke, and land on the phosphor screen.

Recently, CRTs have been employed for use in highly sophisticated electronic devices such as high definition television (HDTV) and OA equipment.

On the one hand, in these applications, the power consumption of the CRT should be reduced to obtain good energy efficiency and the magnetic field leakage due to power consumption should be reduced to protect the user from harmful electronic waves. In order to meet these requirements, the power consumption of the deflection yoke, which is the major source of power consumption, should eventually be reduced.

On the other hand, in order to realize high brightness and resolution of display images on the screen, an increase in the deflection power of the deflection yoke is needed. Specifically, a higher anode voltage is needed for enhancing the brightness of the screen. A correspondingly higher deflection voltage is needed for deflecting the electron beams accelerated by the increased anode voltage. Furthermore, higher deflection frequency, along with the requirement of increased deflection power, is needed to enhance the resolution of the screen. In addition, in order to realize relatively flat CRTs for more convenient use, wide-angle deflection should be performed with respect to the electron beams. Wide-angle deflection also requires increased deflection power.

In this situation, there are needs for developing techniques for allowing CRTs to retain good deflection efficiency while constantly maintaining or reducing the deflection power.

Conventionally, a technique of increasing the deflection efficiency positions the deflection yoke more adjacent to the electron beam paths. The positioning of the deflection yoke is achieved by reducing a diameter of the neck and a neck-side outer diameter of the funnel. However, in such a structure, the electron beams to be applied to the screen corner portions are liable to bombard a neck-side inner wall of the funnel. Consequently, the phosphors coated on the corresponding screen corner portions are not excited and it becomes difficult to obtain good quality screen images.

In order to solve such problems, it has been proposed that the cone portion of the funnel, around which the deflection yoke is mounted, be formed with a shape where a circle gradually changes into a rectangle from a neck-side of the funnel to a panel-side of the funnel. This shape corresponds to the deflection route of the electron beams. In this structure, the size of the cone portion is minimized so that the deflection yoke can be positioned more adjacent to the electron beam paths.

However, in the above technique, because the cone portion has a substantially rectangular overall shape, atmospheric pressure resistance is reduced at the cone portion. Therefore, a potential explosion problem exists in a glass-bodied CRT due to compression stress working in the horizontal and vertical axis directions and tensional stress working in the diagonal axis direction.

When the cone portion of the funnel is formed with a circular shape, the potential explosion problem is absent in the CRT because of the circular symmetry in stress. In contrast, when the cone portion of the funnel is formed with a rectangular shape, the maximum stress is concentrated on the diagonal side of the cone portion so that the atmospheric pressure resistance is deteriorated, causing the potential explosion problem.

Recently, as computer simulation techniques have been rapidly developed, it has become possible to perform a stress analysis with respect to the funnel. With the aid of such a stress analysis, the stress concentrated portions of the funnel are correctly checked and a stress distribution can be made over the funnel in an appropriate manner.

SUMMARY OF THE INVENTION

It is an object of the present invention to provide a CRT which has a funnel cone portion formed with a large thickness at a region ranged from a deflection reference line to an inflection point in a tube axis direction on the basis of a computer simulation technique.

This and other objects may be achieved by a CRT including a panel having an inner phosphor screen, and a funnel having a panel sealing side, a cone portion and a neck sealing side. The panel sealing side of the funnel is sealed to the panel at a phosphor screen-side. A deflection yoke is mounted around the cone portion of the funnel. A neck is sealed to the neck sealing side of the funnel and an electron gun is mounted within the neck. The cone portion of the funnel is formed with a sectional shape where a circle gradually changes into a non-circle from a neck-side of the cone portion to a panel-side of the cone portion.

The cone portion of the funnel has a thickness in a horizontal axis direction and a thickness in a diagonal axis direction, and the ratio of the diagonal thickness to the horizontal thickness ranges from 1.03 to 1.21. The diagonal thickness of the cone portion non-monotonically increases or decreases from the panel sealing side to the neck sealing side and at least one or more maximum thickness values or one or more minimum thickness values are present between the panel sealing side and the neck sealing side.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
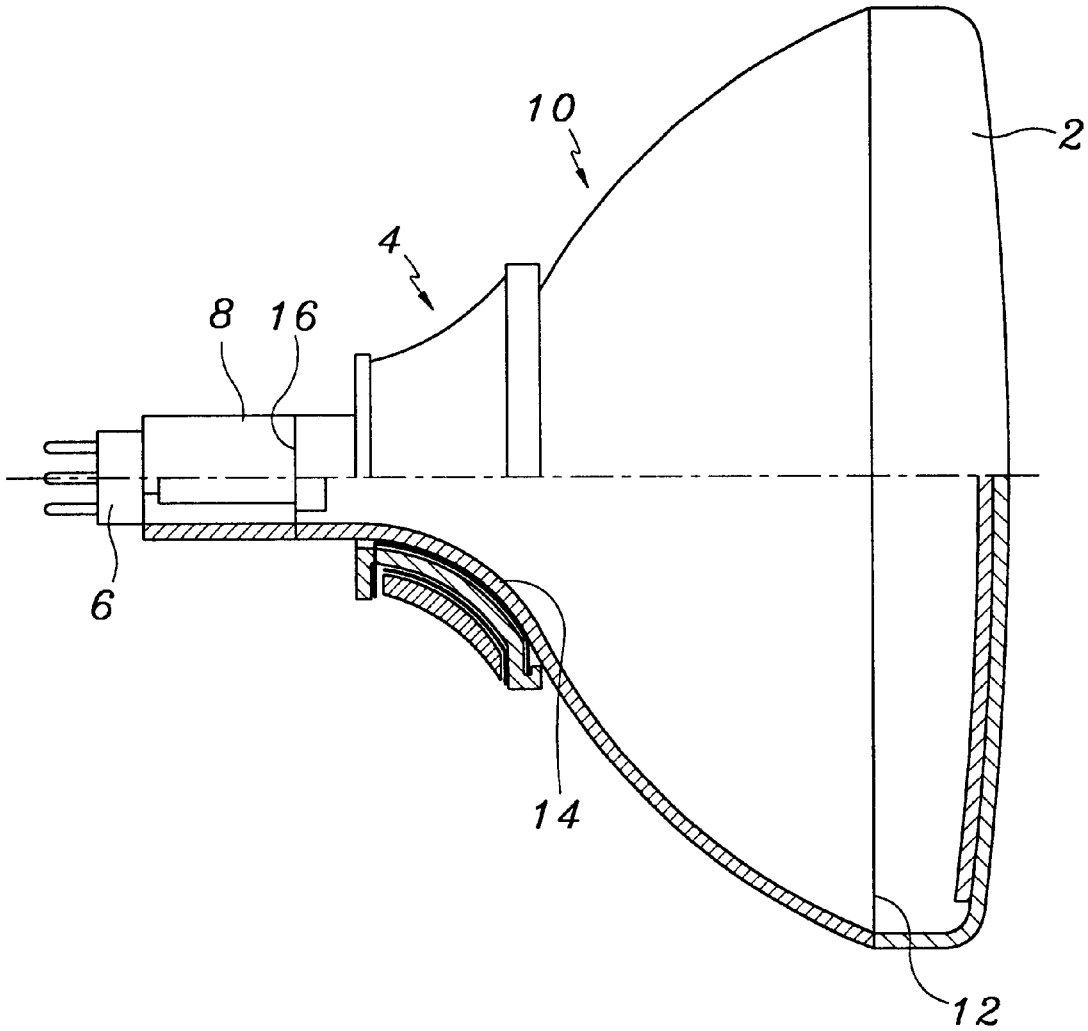
FIG. 1 is a sectional view of a CRT according to a preferred embodiment of the present invention.
Figure 2:
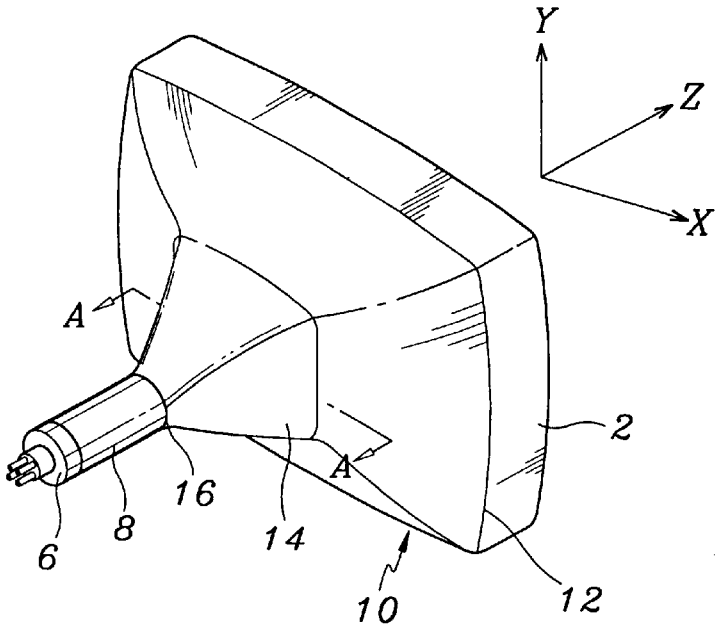
FIG. 2 is a rear perspective view of the CRT shown in FIG. 1.

FIGS. 1 to 4 are views illustrating a CRT according to a preferred embodiment of the present invention. As shown in FIG. 1, the CRT includes a panel 2 having an inner phosphor screen, and a funnel 10 connected to the panel 2 at the phosphor screen side. The funnel 10 has a cone portion 14 at its free end side. A deflection yoke 4 is mounted around an outer periphery of the funnel 10 which corresponds to the cone portion 14. A neck 8 is connected to the funnel 10, and an electron gun 6 is mounted within the neck 8.

The cone portion 14 of the funnel 10 is formed with a sectional shape where a circle gradually changes into a non-circle (for example, a rectangle) from the neck-side of the cone portion 14 to the panel-side.

Figure 3:
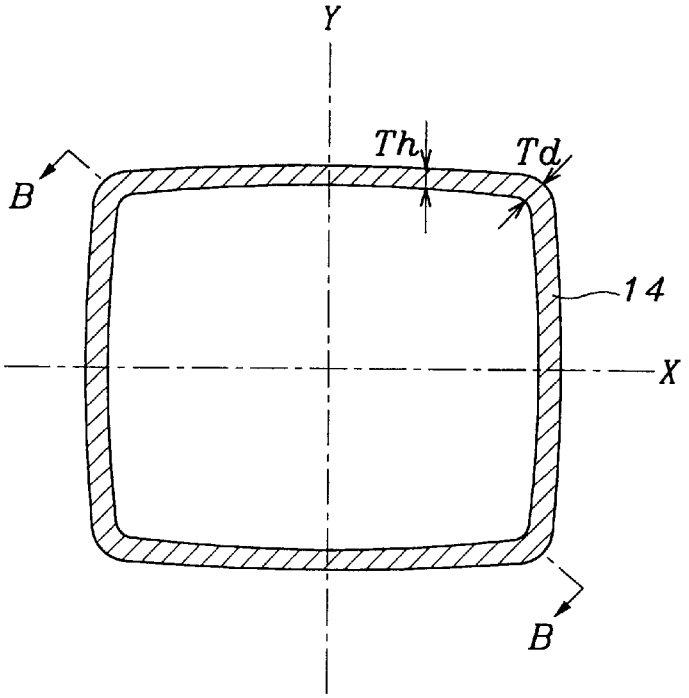
FIG. 3 is a sectional view of a CRT taken along the A—A line of FIG. 2.
Figure 4:
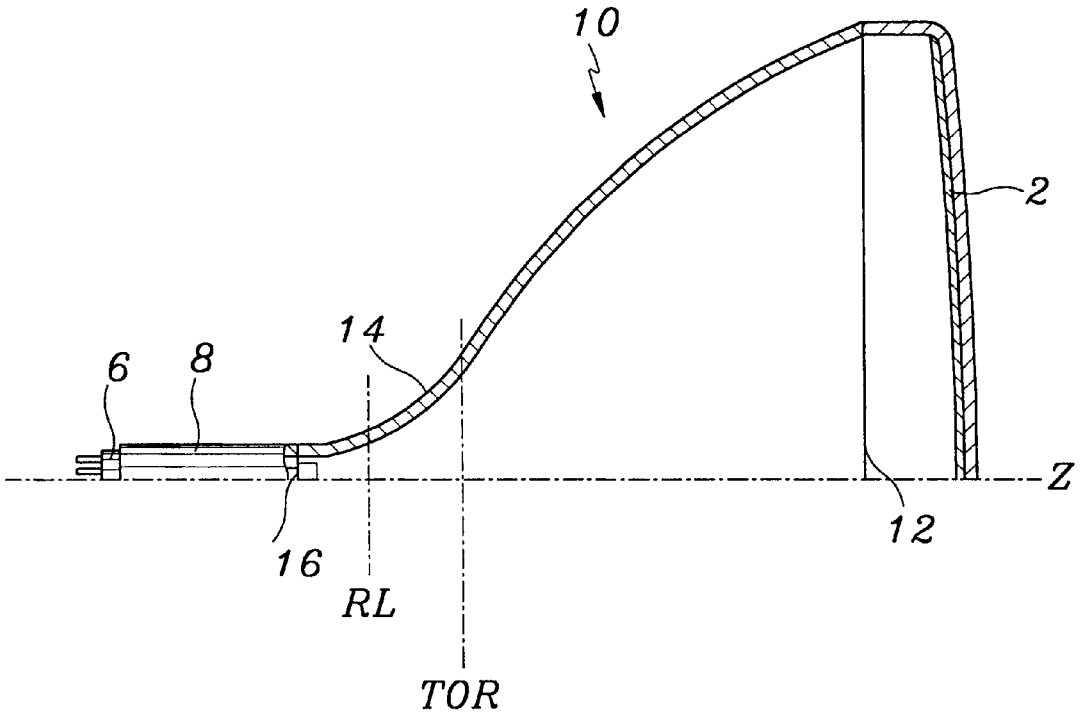
FIG. 4 is a sectional view of a CRT taken along the B—B line of FIG. 3.

The cone portion 14 has a thickness Th in a horizontal direction and a thickness Td in a diagonal direction as shown in FIG. 3. The ratio of the diagonal thickness Td to the horizontal thickness Th at the area between an inflection point or the so-called top of round (TOR) and the deflection reference line (RL) is established to be 1 or more, or particularly to satisfy the following mathematical formula 1.

$$1.03 \leqq Td/Th \leqq 1.21 \qquad \text{[Mathematical formula 1]}$$

Where two lines are drawn each from one of opposite screen diagonal angular points of the panel 2 to a tube axis Z line such that the angle between the tube axis Z line and each of the two lines may reach half the maximum deflection angle, the RL indicates the meeting portion of the two lines on the tube axis Z line.

Where the funnel 10 has an internal surface with a concave shape proceeding from a panel sealing side 12 in the neck-side direction and a convex shape proceeding from a neck sealing side 16 in the panel-side direction, the TOR indicates the borderline portion between the concave-shaped portion and the convex-shaped portion.

Table 1 lists maximum stresses occurring when the ratio of the diagonal thickness Td to the horizontal thickness Th varies between the TOR and the RL. The stress analysis was performed by using a computer simulation technique.

TABLE 1

| Td/Th | Maximum stress (kgf/cm$^2$) |
|---|---|
| 0.8 | 107.0 |
| 0.9 | 100.3 |
| 1.0 | 93.6 |
| 1.1 | 87.5 |
| 1.2 | 81.3 |

It can be noticed from Table 1 that when the ratio of Td to Th is 1.0, 1.1 and 1.2, respectively, the maximum stress is relatively lower.

The internal surface of the cone portion 14 is diagonally formed with a shape where the diagonal thickness Td non-monotonically increases or decreases from the panel sealing side 12 to the neck sealing side 16 and at least one or more maximum thickness values or one or more minimum thickness values are present in that area.

Particularly, the internal surface of the cone portion 14 is diagonally formed with a shape where the diagonal thickness Td non-monotonically increases or decreases from the panel sealing side 12 to the neck sealing side 16 and at least one or more maximum thickness values or one or more minimum thickness values are present between the TOR and the neck sealing side 12.

Figure 5:
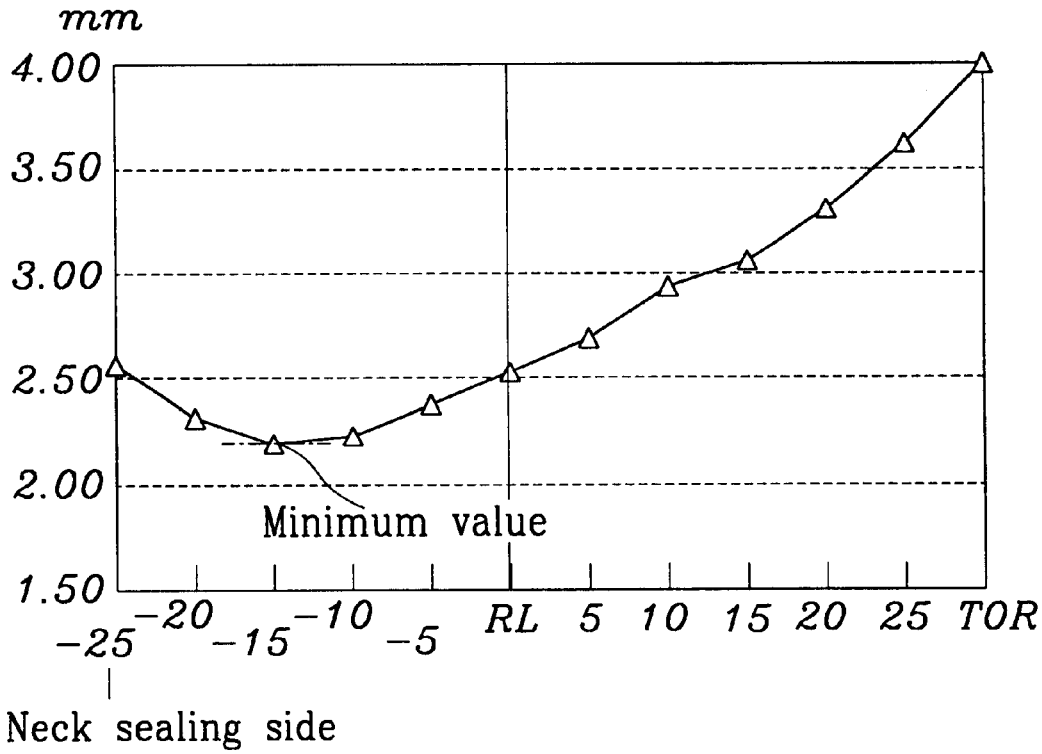
FIG. 5 is a graph illustrating thickness variation of a cone portion shown in FIG. 1 on the basis of computer simulation analysis.

FIG. 5 is a graph illustrating the diagonal thickness variation between the TOR and the neck sealing side 16 on the basis of the computer simulation technique. It can be noted from the graph that one minimal thickness value is present particularly between the RL and the neck sealing side 16. As described above, it is also possible that one or more minimum thickness values or one or more maximum thickness values may be present between the TOR and the neck sealing side 16 or between the panel sealing side 12 and the neck sealing side 16.

Figure 6:
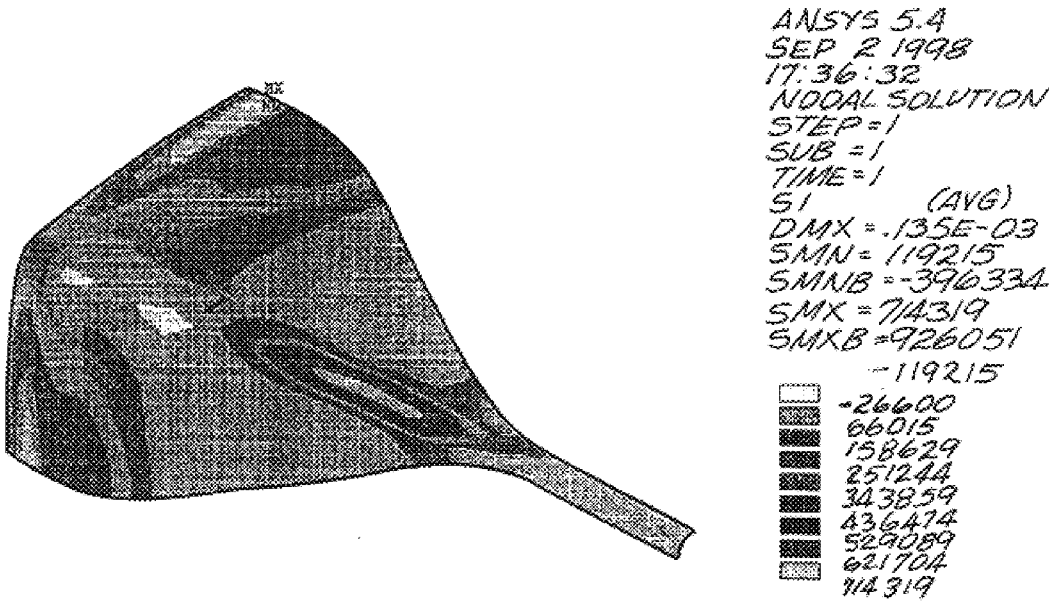
FIG. 6 is a graph illustrating a stress distribution state of the CRT shown in FIG. 1 on the basis of computer simulation analysis.
Figure 7:
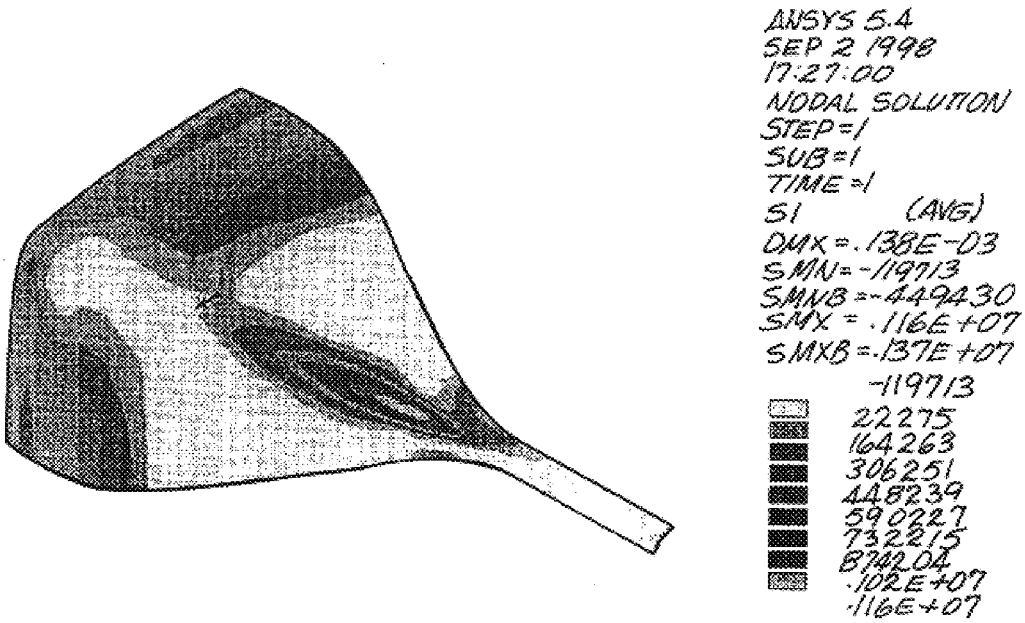
FIG.7(Prior Art)
FIG. 7 is a graph illustrating a stress distribution state of a prior art CRT on the basis of computer simulation analysis.

FIG. 6 is a graph illustrating a stress distribution state of the CRT shown in FIG. 1 on the basis of computer simulation analysis. FIG. 7 is a graph illustrating a stress distribution state of a prior art CRT on the basis of computer simulation analysis.

As shown in FIG. 7, the conventional CRT exhibits a maximum stress value concentrated on the diagonal portion of the cone portion 14. In contrast, as shown in FIG. 6, the inventive CRT exhibits the stress values widely distributed over the cone portion 14.

Accordingly, in the inventive CRT, the thickness of the cone portion 14 can be maximized owing to the stress distribution and therefore the cone portion 14 can be formed with a non-circular (e.g., rectangle) shape while maintaining good atmospheric pressure resistance.

While the present invention has been described in detail with reference to the preferred embodiments, those skilled in the art will appreciate that various modifications and substitutions can be made thereto without departing from the spirit and scope of the present invention as set forth in the appended claims.

This application claims priority of Korean Application No. 98-48059 filed Nov. 10, 1998 in the Korean Industrial Property Office, the content of which is incorporated herein by reference.

What is claimed is:

1. A cathode ray tube comprising:

a panel having an inner phosphor screen;

a funnel having a panel sealing side, a cone portion and a neck sealing side, the panel sealing side of the funnel being sealed to the panel;

a deflection yoke mounted around the cone portion of the funnel;

a neck sealed to the neck sealing side of the funnel; and an electron gun mounted within the neck;

wherein the cone portion of the funnel is formed with a sectional shape where a circle changes into a non-circle from a neck-side of the cone portion to a panel-side of the cone portion;

wherein the cone portion of the funnel has a thickness in a horizontal axis direction and a thickness in a diagonal axis direction, and the ratio of the diagonal thickness to the horizontal thickness is in the range from 1.03 to 1.21.

2. The cathode ray tube of claim 1 wherein the diagonal thickness of the cone portion non-monotonically increases or decreases from the panel sealing side to the neck sealing side and at least one maximum thickness value or at least one minimum thickness value is present between the panel sealing side and the neck sealing side.

3. The cathode ray tube of claim 1 wherein the diagonal thickness of the cone portion non-monotonically increases or decreases from the panel sealing side to the neck sealing side and at least one maximum thickness value or at least one minimum thickness value is present between an inflection point and the neck sealing side.

4. A cathode ray tube comprising:

a panel having an inner phosphor screen;

a funnel having a panel sealing side, a cone portion and a neck sealing side, the panel sealing side of the funnel being sealed to the panel;

a deflection yoke mounted around the cone portion of the funnel;

a neck sealed to the neck sealing side of the funnel; and an electron gun mounted within the neck;

wherein the cone portion of the funnel is formed with a sectional shape where a circle changes into a non-circle from a neck-side of the cone portion to a panel-side of the cone portion;

wherein the cone portion of the funnel has a thickness in a horizontal axis direction and a thickness in a diagonal axis direction, and the ratio of the diagonal thickness to the horizontal thickness is in the range from 1.03 to 1.21 at the area between an inflection point TOR and a deflection reference line RL of the funnel.

5. The cathode ray tube of claim 4 wherein the diagonal thickness of the cone portion non-monotonically increases or decreases from the panel sealing side to the neck sealing side and at least one maximum thickness values or at least one minimum thickness value is present between the panel sealing side and the neck sealing side.

6. The cathode ray tube of claim 4 wherein the diagonal thickness of the cone portion non-monotonically increases or decreases from the panel sealing side to the neck sealing side and at least one maximum thickness value or at least one minimum thickness value is present between an inflection point and the neck sealing side.

* * * * *